US007780018B1

(12) United States Patent
Sauder et al.

(10) Patent No.: US 7,780,018 B1
(45) Date of Patent: Aug. 24, 2010

(54) LOCKER SHELF ASSEMBLY

(75) Inventors: Myrl D. Sauder, Archbold, OH (US); Ronald D. Roth, Wauseon, OH (US)

(73) Assignee: Sauder Woodworking Co., Archbold, OH (US)

( * ) Notice: Subject to any disclaimer, the term of this patent is extended or adjusted under 35 U.S.C. 154(b) by 0 days.

(21) Appl. No.: 12/484,426

(22) Filed: Jun. 15, 2009

(51) Int. Cl.
*A47F 5/00* (2006.01)
*A47B 43/00* (2006.01)

(52) U.S. Cl. ..... 211/134; 211/189; 211/186; 211/153; 108/193; 108/147.16; 312/264

(58) Field of Classification Search ..... 211/134, 211/188, 189, 153; 312/257.1, 245, 263, 312/264, 351, 107, 108; 108/193, 147.16
See application file for complete search history.

(56) References Cited

U.S. PATENT DOCUMENTS 1,654,409 A * 12/1927 Browne ..... 108/29
2,510,243 A * 6/1950 Mohring ..... 211/134
2,645,545 A * 7/1953 Rozaffy ..... 312/108
2,741,525 A * 4/1956 Sywert ..... 312/408
2,766,092 A * 10/1956 Dennison ..... 312/257.1
2,840,439 A * 6/1958 Sharpe ..... 312/351
2,887,926 A * 5/1959 Edwards ..... 411/38
3,360,321 A * 12/1967 Novales ..... 312/257.1
3,589,784 A * 6/1971 Winkels ..... 312/263
3,790,421 A * 2/1974 Habgood, Jr. ..... 156/242
4,236,460 A * 12/1980 Poupko ..... 108/41
4,283,099 A 8/1981 Burton
4,500,146 A 2/1985 Peterson
4,793,664 A 12/1988 Jackson
4,808,875 A 2/1989 Edwards
4,818,044 A 4/1989 Dobry
5,221,013 A 6/1993 Santucci
5,251,973 A 10/1993 Hazan
5,372,415 A * 12/1994 Tisbo et al. ..... 312/108
5,415,472 A 5/1995 Brise
5,421,646 A 6/1995 McNamara et al.
5,454,331 A * 10/1995 Green ..... 108/180
5,671,990 A 9/1997 Teasdale
5,746,331 A 5/1998 Kurtis
6,877,826 B2 4/2005 Wood et al.

(Continued)

OTHER PUBLICATIONS

"LockerShelf—The Ultimate in Locker Shelving," Brochure, at least as early as Jan. 6, 2010, pp. 1-6, published by The LockerShelf Company, Kendall Park, NJ.

(Continued)

*Primary Examiner*—Darnell M Jayne
*Assistant Examiner*—Patrick Hawn
(74) *Attorney, Agent, or Firm*—MacMillan, Sobanski & Todd, LLC

(57) ABSTRACT

A locker shelf assembly which has first and second side walls and a shelf. Each of the side walls includes substantially horizontally extending grooves. The shelf has a first end and a second end. The first end of the shelf is positioned in the groove of the first side wall and the second end of the shelf is positioned in the groove of the second side wall. When the assembly is positioned in a locker, the shelf acts to position the first and second side walls against the walls of the locker.

9 Claims, 11 Drawing Sheets

U.S. PATENT DOCUMENTS

| | | | |
|---|---|---|---|
| 7,007,614 | B2 | 3/2006 | Gaunt et al. |
| 7,353,958 | B2 | 4/2008 | Shapiro |
| 2007/0051284 | A1 | 3/2007 | Shapiro et al. |
| 2008/0184537 | A1 | 8/2008 | Meckert et al. |

OTHER PUBLICATIONS

"Meet the LockerShelf—The Ultimate in Locker Shelving," Web site, at least as early as Jan. 6, 2010, p. 1, published by The LockerShelf Company, Kendall Park, NJ.

* cited by examiner

LOCKER SHELF ASSEMBLY

TECHNICAL FIELD

The invention relates generally to shelves. More specifically, the invention is directed to a locker shelf assembly.

BACKGROUND OF THE INVENTION

A locker usually includes a single shelf located near the top of the locker. This often does not provide enough shelf space for storage. The invention provides a shelf assembly for additional self space in a locker.

BRIEF SUMMARY OF THE INVENTION

The invention is a locker shelf assembly having first and second side walls each including substantially horizontally extending grooves. A shelf is positioned in the grooves.

DETAILED DESCRIPTION OF THE INVENTION

Figure 1:
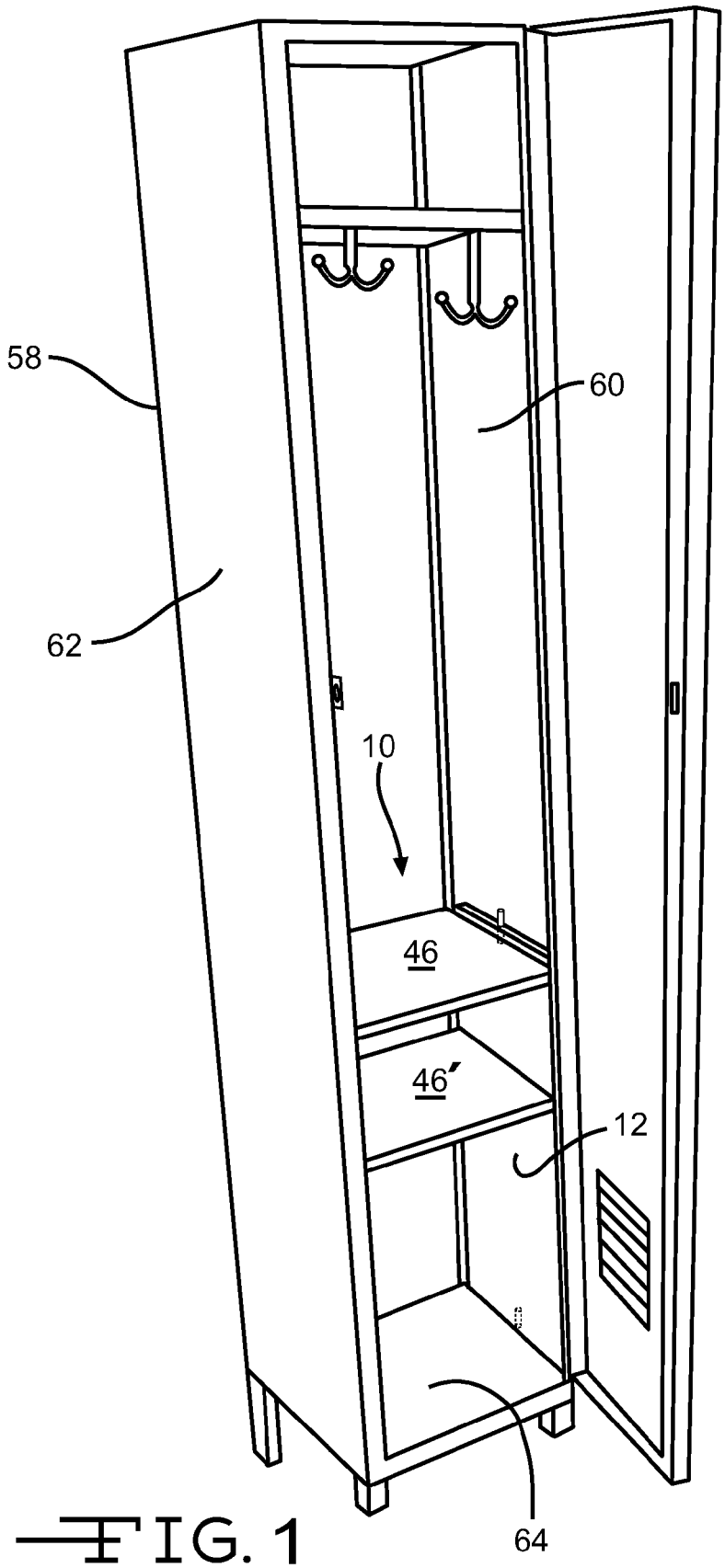
FIG. 1 is a perspective view of an embodiment of the locker shelf assembly positioned in a locker.
Figure 2:
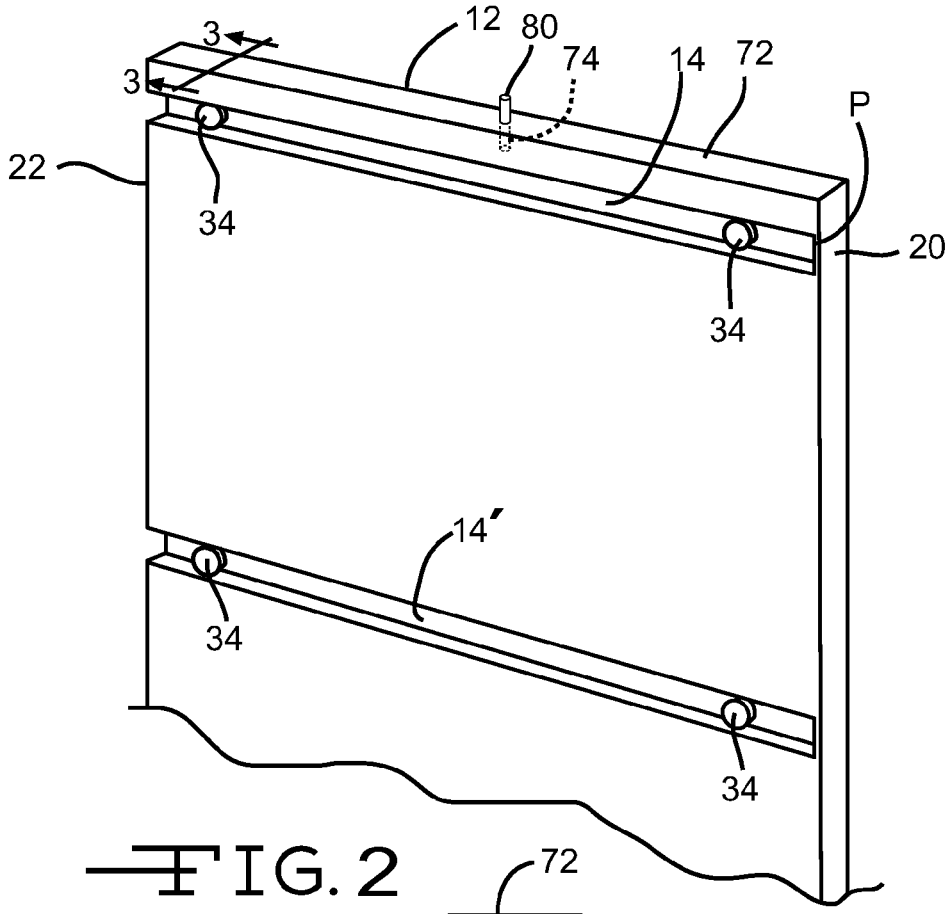
FIG. 2 is a perspective view of one of the sides of the locker shelf assembly.

Referring to the drawings, the locker shelf assembly 10 has a first side 12 including a substantially horizontally extending first side groove 14 and a second side 16 including a substantially horizontally extending second side groove 18. As shown in FIG. 2, each of the first and second sides 12 and 16 has a front 20 and a back 22. Each of the first and second side grooves 14 and 18 extends from the back 22 to a point P spaced from the front 20. This results in the first and second grooves 14 and 18 being closed at the respective fronts 20. But the first and second grooves 14 and 18 are open at the respective backs 22.

Figure 3:
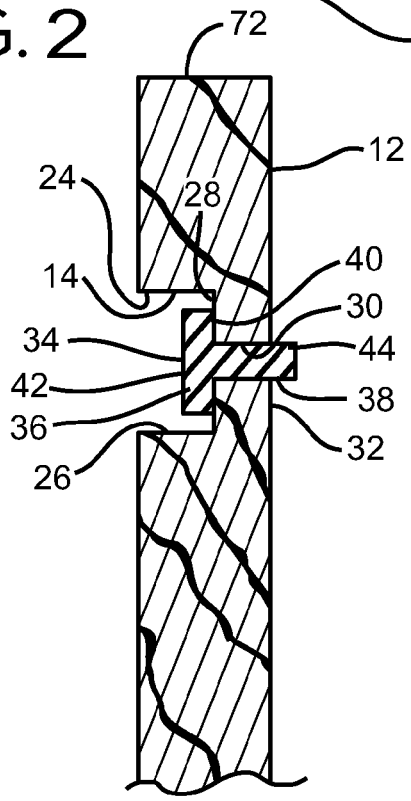
FIG. 3 is a cross-sectional view taken along line 3-3 of FIG. 2.
Figure 4:
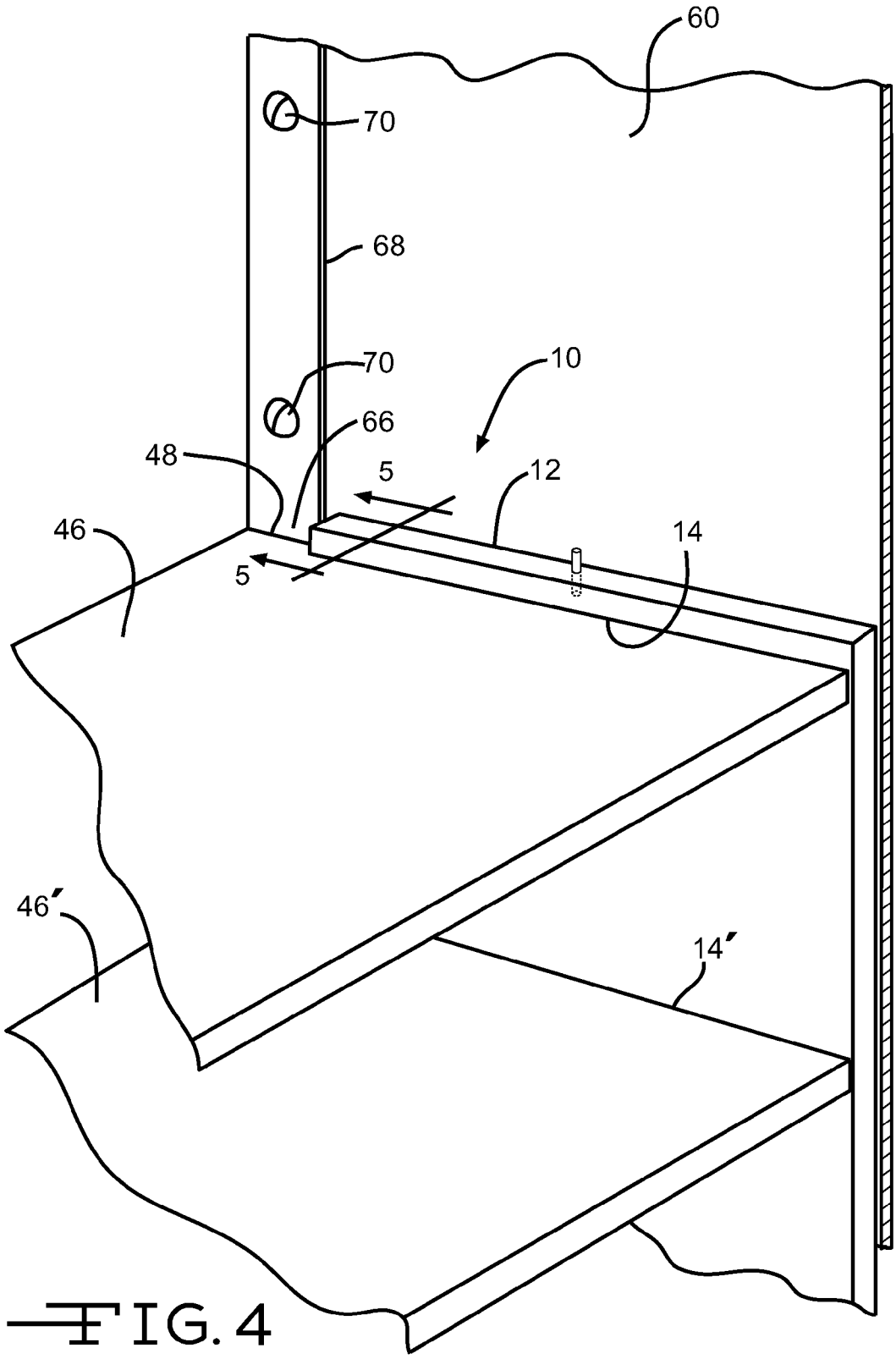
FIG. 4 is a perspective view of one of the sides with two shelves positioned in a locker.

Referring to FIGS. 2 and 3, each of the first and second side grooves 14 and 18 has a top wall 24, a bottom wall 26, and an interior wall 28 extending between the top and bottom walls 24 and 26. In an embodiment, the top and bottom walls 24 and 26 are substantially parallel and the interior wall 28 is substantially perpendicular to the top and bottom walls 24 and 26. In an embodiment, openings 30 extend between the exterior surfaces 32 of each of the first and second side walls 12 and 16 and each of the interior walls 28.

Still referring to FIGS. 2 and 3, the assembly 10 has flexible inserts 34 for positioning in the openings 30. In an embodiment, each insert 34 has a head 36 and a shank 38. The head 36 has an interior wall surface 40 for engaging the interior wall 28 and a shelf surface 42 for engaging the shelf as described below. The shank 38 extends outwardly from the interior wall surface 40 for positioning in the opening 30. As shown in FIG. 3, a portion 44 of the shank 38 extends outwardly from the exterior surface 32 when the insert 34 is positioned in the opening 30.

Figure 5:
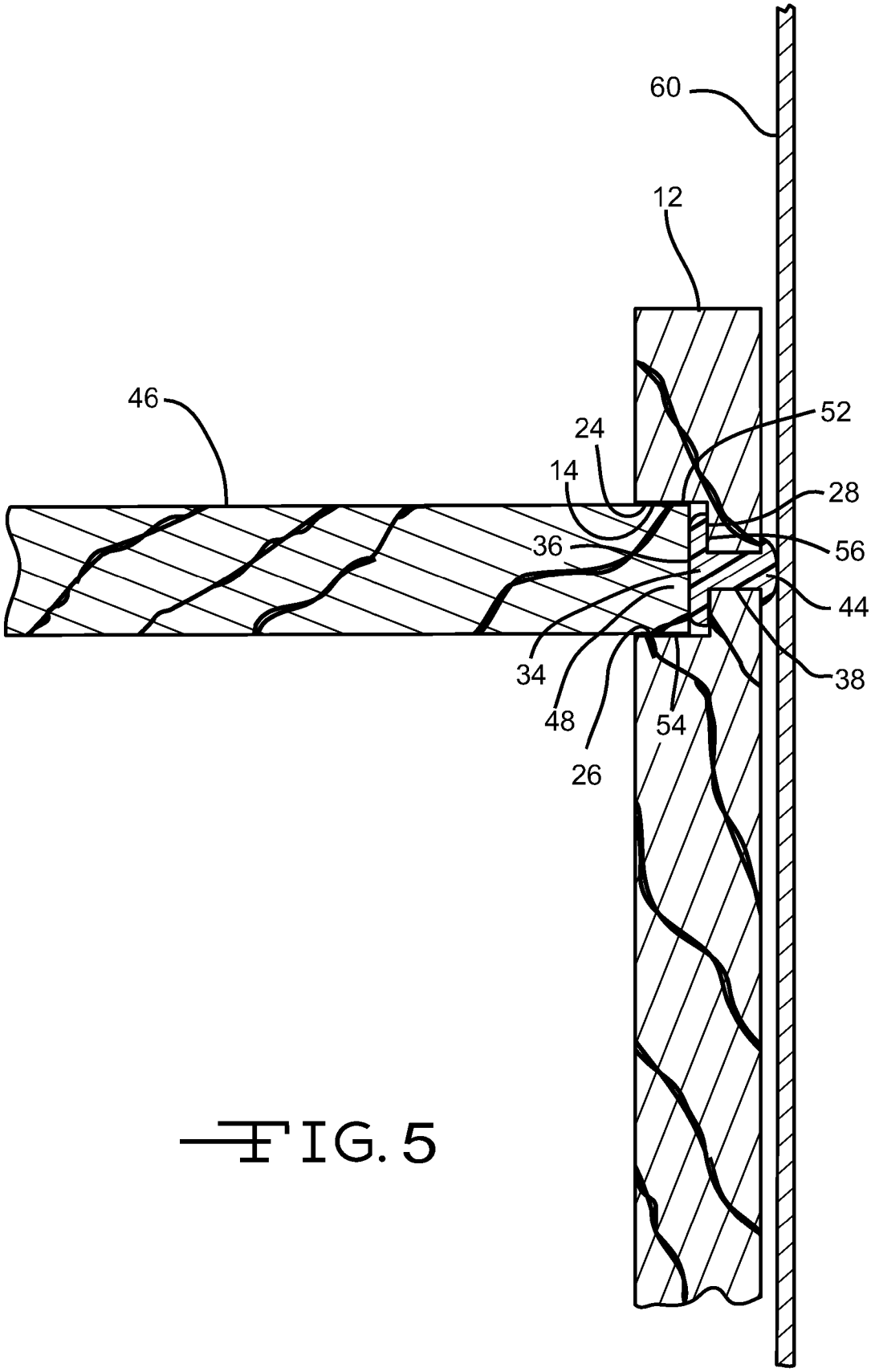
FIG. 5 is a cross-sectional view taken along line 5-5 of FIG. 4.
Figure 6:
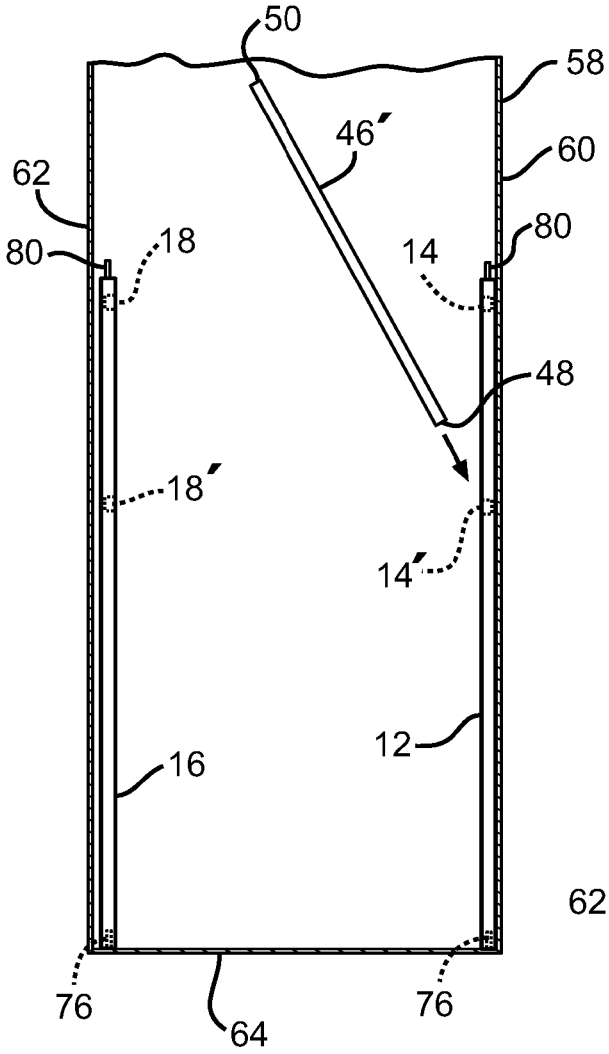
FIG. 6 is a front elevational view of a first shelf being positioned between the first and second sides of the locker shelf assembly in a locker.
Figure 7:
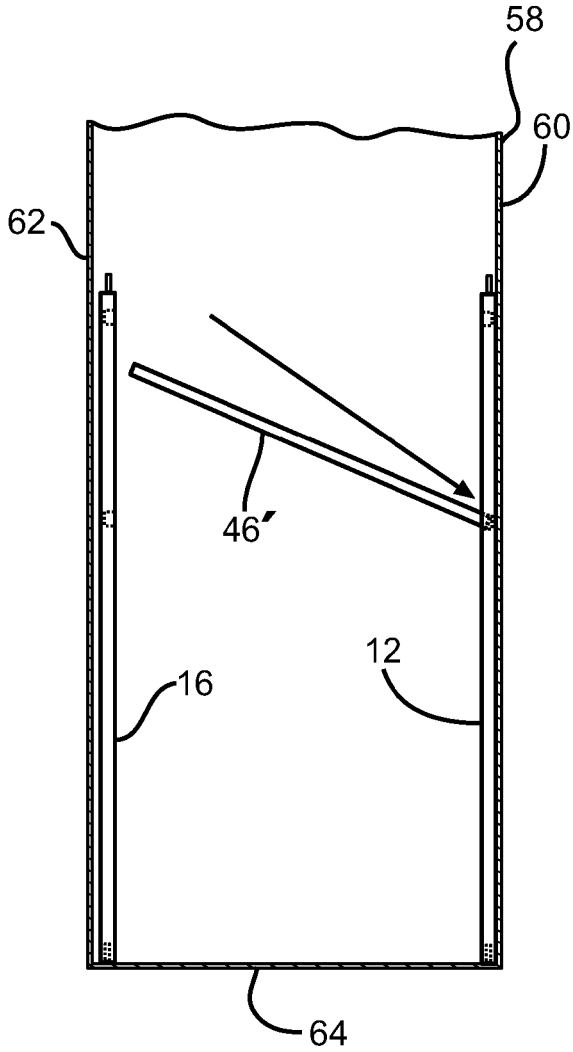
FIG. 7 is a view similar to FIG. 6 in which the first shelf is positioned in the first side.

Referring to FIGS. 1 and 4-6, the assembly 10 has a shelf 46 including a first side end 48 and a second side end 50. As shown in FIG. 5, each of the first and second side ends 48 and 50 has an upper surface 52 for engaging the top wall 24, a lower surface 54 for engaging the bottom wall 26, and an outer surface 56 for positioning adjacent to the interior wall 28. In an embodiment, the outer surface 56 engages the head 36 of the insert 34.

Figure 13:
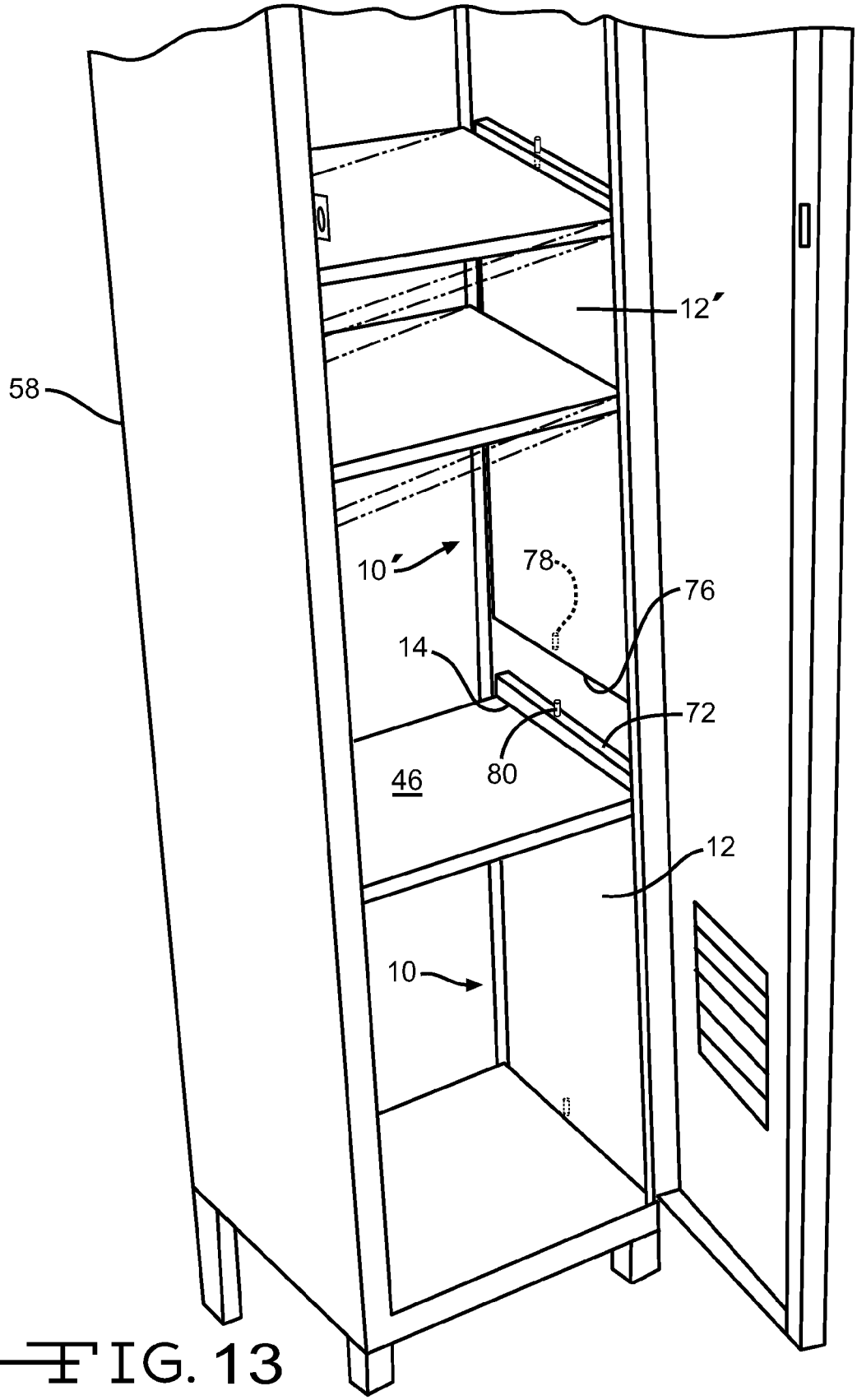
FIG. 13 is a perspective view similar to FIG. 1 in which a second locker shelf assembly according to the invention is being positioned on a first locker shelf assembly according to the invention.
Figure 14:
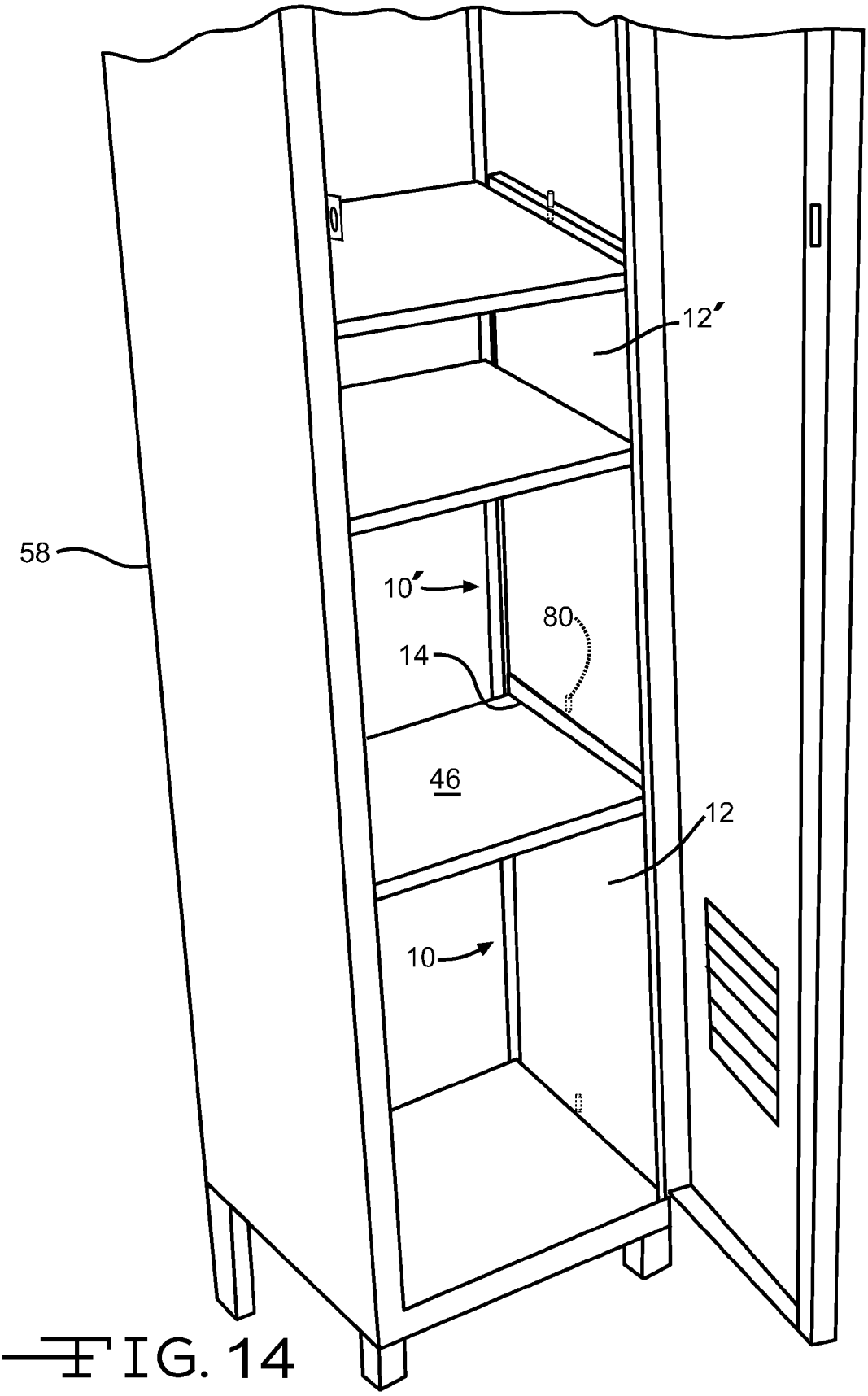
FIG. 14 is a perspective view similar to FIG. 13 in which the second locker shelf assembly is positioned on the first locker shelf assembly.

In the embodiment shown in FIGS. 1-10, the assembly 10 has a first side 12 including two first side grooves 14 and 14', a second side 16 including two second side grooves 18 and 18', and two shelves 46 and 46'. It should be understood that the assembly 10 can have more than two shelves 46. In the embodiment shown in FIGS. 13 and 14, the assembly 10 has a first side 12 including one first side groove 14 and a second side 16 including a second side groove 18, and one shelf 46.

Many materials may be used in the construction of the components of the assembly 10. In an embodiment, the first and second sides 12 and 14 are comprised of wood such as a composite wood material covered with a paper laminate. In an embodiment, the flexible insert 34 is comprised of a resilient material such as plastic.

Figure 8:
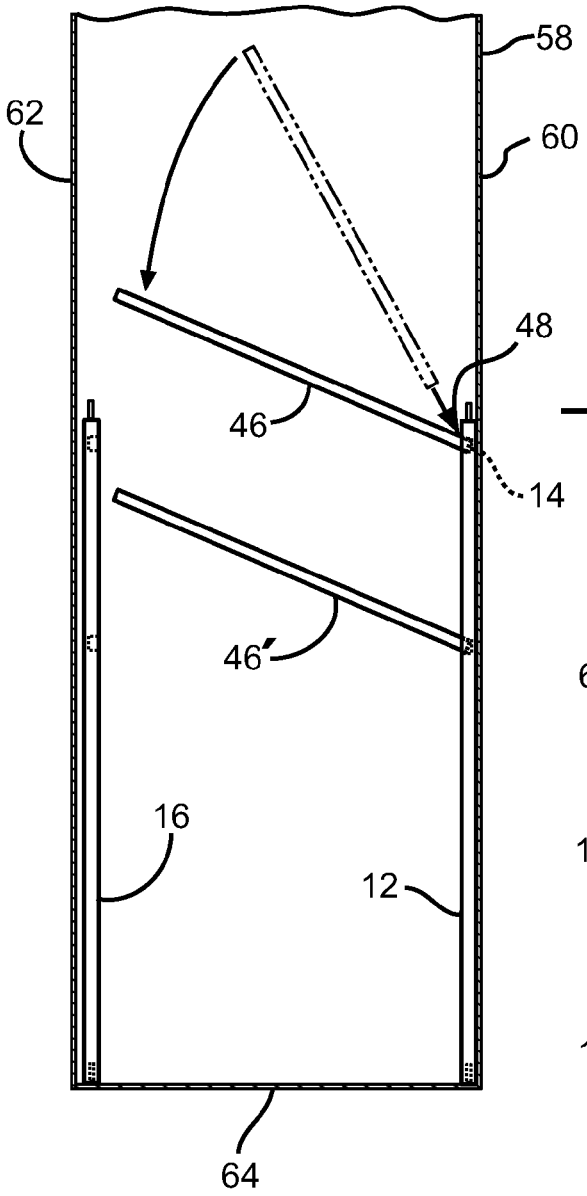
FIG. 8 is a view similar to FIG. 6 in which a second shelf is position in the first side.
Figure 9:
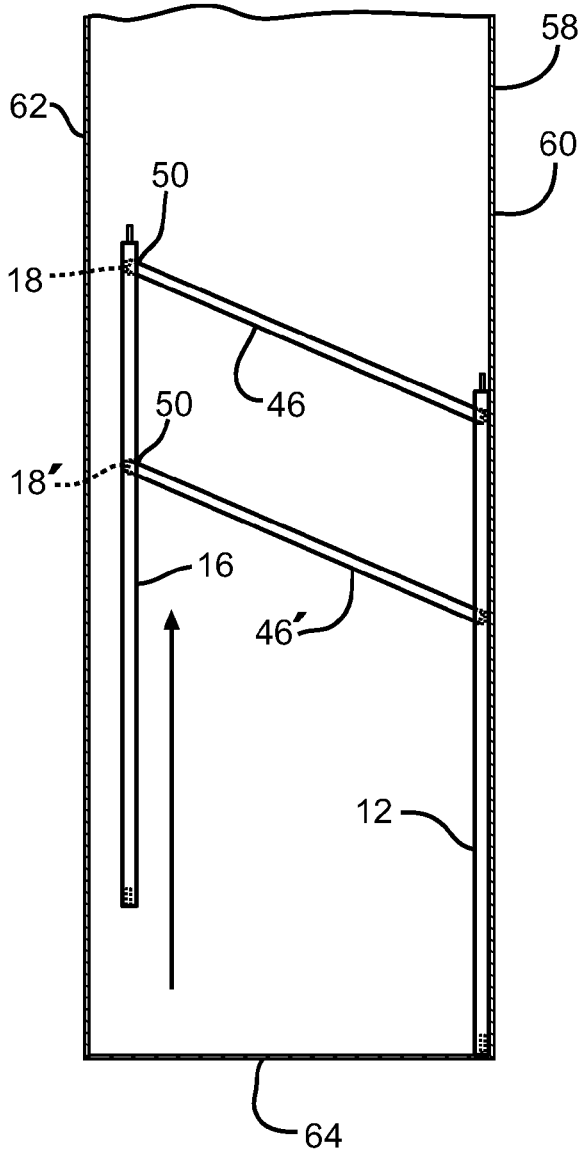
FIG. 9 is a view similar to FIG. 6 in which the first and second shelves are positioned in the second side as the second side is raised.
Figure 10:
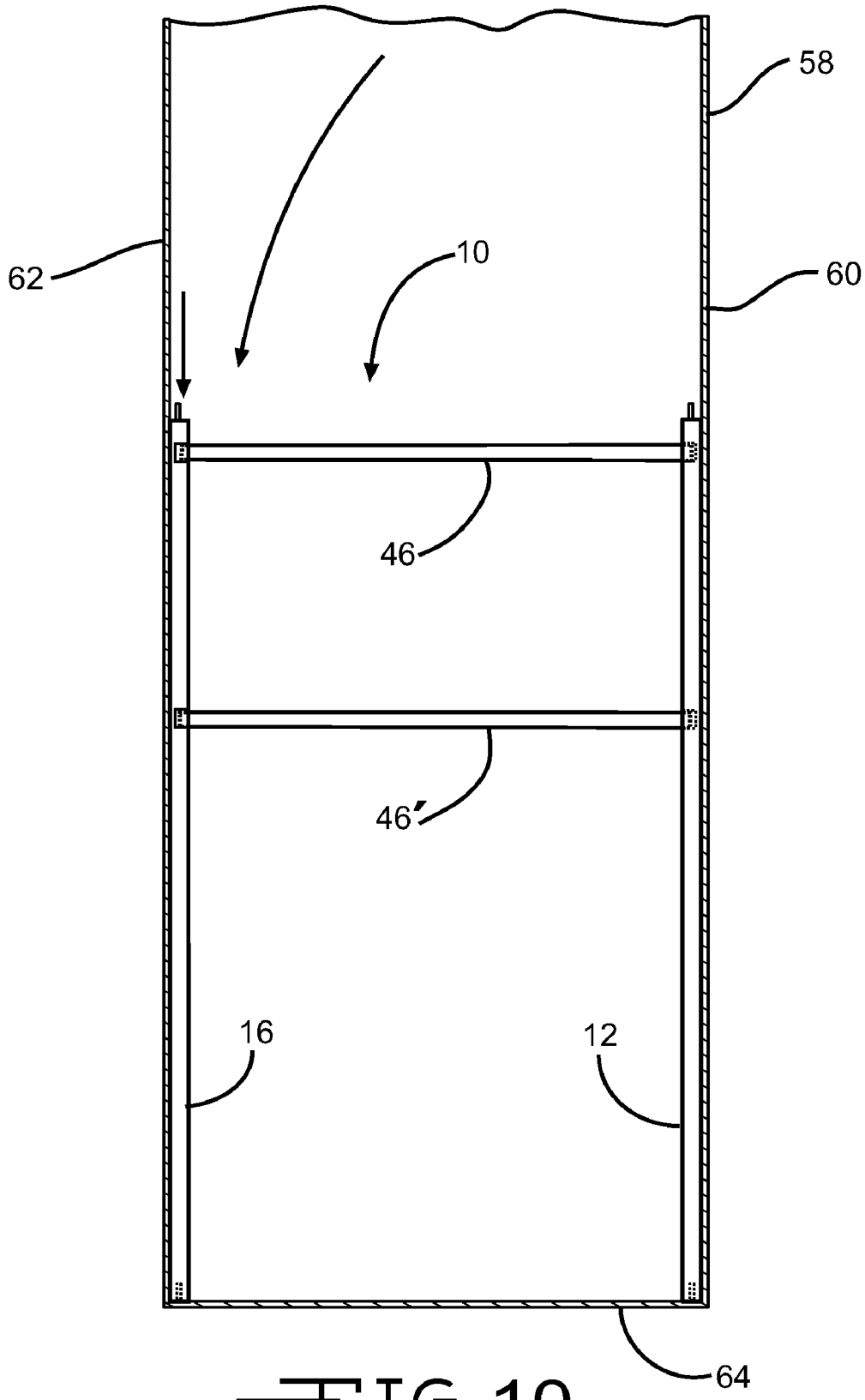
FIG. 10 is a view similar to FIG. 6 in which the second side is lowered to position the locker shelf assembly in the locker.
Figure 11:
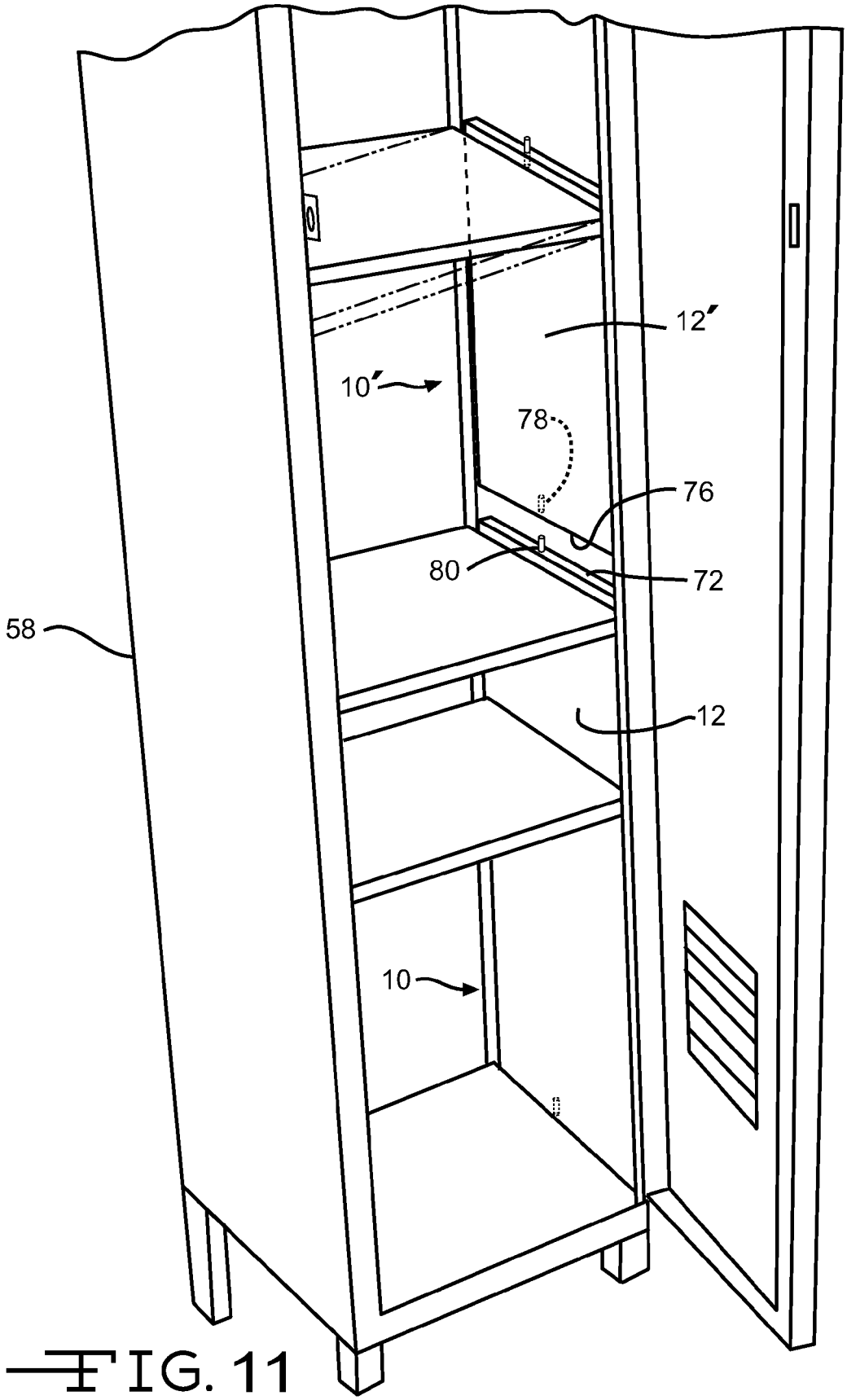
FIG. 11 is a perspective view similar to FIG. 1 in which a second locker shelf assembly according to the invention is being positioned on a first locker shelf assembly according to the invention.
Figure 12:
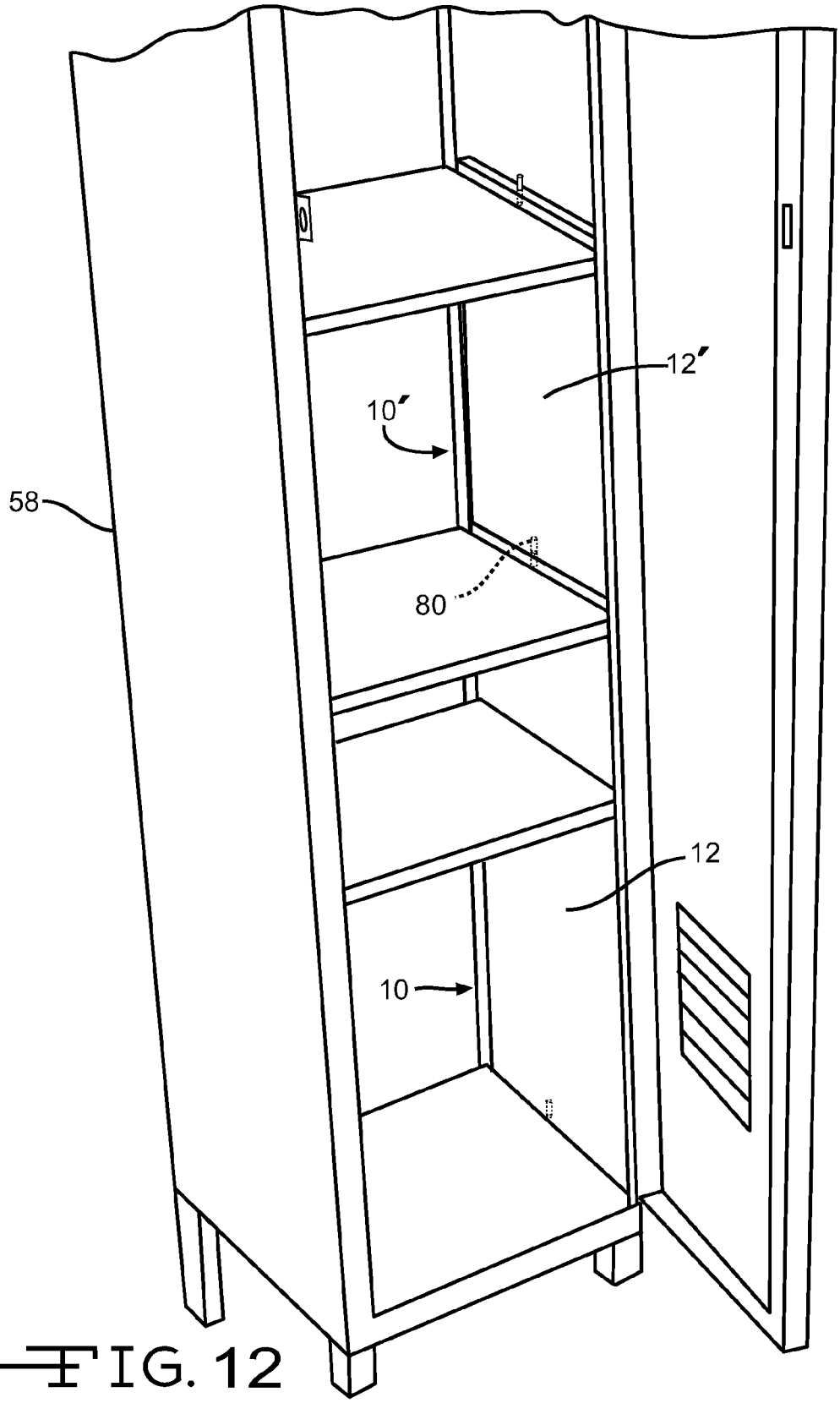
FIG. 12 is a perspective view similar to FIG. 11 in which the second locker shelf assembly is positioned on the first locker shelf assembly.

Referring to FIGS. 1, 4, 5 and 6-7, the assembly 10 is for use in a locker 58 having a first locker wall 60, a second locker wall 62, and a locker bottom 64. As shown in FIGS. 6-10, the assembly 10 is positioned in the locker 58 by placing the first and second sides 12 and 14 adjacent to the first and second locker walls 60 and 62, respectively, and the locker bottom 64. The first side end 48 of the shelf 46' is positioned in the first side groove 14' as indicated by the arrows in FIGS. 6 and 7. As shown in FIG. 8, the first side end 48 of the shelf 46 is positioned in the first side groove 14 as indicated by the arrows. As shown in FIG. 9, the second side 16 is raised as indicated by the arrow to position the second side ends 50 of the shelves 46 and 46' in the respective second side grooves 18 and 18'. As shown in FIG. 10, the second side 16 is then lowered as indicated by the arrows to position the assembly 10 in the locker 58.

Referring to FIG. 5, when the assembly 10 is positioned in the locker 58, the outer surfaces 56 of the shelves 46 and 46' engage the heads 36 of the flexible inserts 34 to cause the portions 44 of the shanks 38 to engage the first and second locker walls 60 and 62. This maintains the shelves 46 and 46' within the first and second side grooves 14, 14' and 18, 18' to firmly position the assembly in the locker 58. The flexible inserts 34 are compressible and movable to accommodate for variations in widths of lockers. As shown for example in FIG. 4, the first and second sides 12 and 14 and the shelves 46 and 46' may be sized and adapted to form notches 66 to receive structures in the locker 58 such as flanges 68 and bolts 70.

Referring to FIGS. 2, 3, 6 and 11-14, each of the first and second sides 12 and 16 includes a top 72 having a top peg opening 74 and a bottom 76 having a bottom peg opening 78. As shown in FIGS. 11-14, a first locker shelf assembly 10 can be positioned on a second locker shelf assembly 10' in the locker 58. Pegs 80 can be positioned in the top peg openings 74 of the first and second sides 12 and 16 of the first locker shelf assembly 10 and the bottom peg openings 78 of the respective first and second sides 12 and 16 of the second locker shelf assembly 10' to provide stability. In an embodiment, the pegs 80 are comprised of metal.

While the invention has been described with reference to particular embodiments, it should be understood that various changes may be made and equivalents may be substituted for elements thereof without departing from the essential scope of the invention. In addition, many modifications may be made to adapt a particular situation or material to the teachings of the invention without departing from the essential scope thereof. Therefore, it is intended that the invention not be limited to the particular embodiments, but that the invention shall include all embodiments falling within the scope of the claims.

What is claimed is:

1. A locker shelf assembly comprising:

a first side having a substantially horizontally extending first side groove and a first side exterior surface, the first side groove having a first side top wall, a first side bottom wall, and a first side interior wall extending between the first side top and bottom walls, the first side having a first side opening extending between the first side exterior surface and the first side interior wall;

a second side having a substantially horizontally extending second side groove and a second side exterior surface, the second side groove having a second side top wall, a second side bottom wall, and a second side interior wall extending between the second side top and bottom walls, the second side having a second opening extending between the second side exterior surface and the second side interior wall;

a shelf having a first side end and a second side end, the first side end for positioning in the first side groove and the second side end for positioning in the second side groove, each of the first and second side ends having an outer surface; and flexible first side and second side inserts being comprised entirely of a resilient material for positioning in the first side and second side openings, each of the first side and second side inserts having a head and a shank, each of the heads having an interior wall surface for engaging the interior walls of the first and second side grooves and a shelf surface for engaging the outer surfaces of the shelf, each of the shanks extending outwardly from the interior wall surfaces for positioning in the openings, each of the shanks having a portion for extending outwardly from the first and second side exterior surfaces when the inserts are positioned in the openings, each of the shanks is compressible and movable to accommodate for variation in width of a locker.

2. The locker shelf assembly of claim 1, wherein each of the first and second sides has a front and a back, the first and side grooves extending from the backs to points spaced from the fronts, respectively.

3. The locker shelf assembly of claim 1, wherein the top and bottom walls of the first and second side grooves are substantially parallel to one another and the interior walls are substantially perpendicular to the top and bottom walls, each of the first and second side ends of the shelf having an upper surface for engaging the top walls and a lower surface for engaging the bottom walls, and the outer surfaces of the shelf are for positioning adjacent to the interior walls.

4. The locker shelf assembly of claim 1, wherein the first and second sides and the shelf are comprised of wood.

5. The locker shelf assembly of claim 1, wherein the first and second sides and the shelf are comprised of a composite wood material covered with a paper laminate.

6. The locker shelf assembly of claim 1, wherein each of the first and second sides has a top peg opening and a bottom peg opening.

7. The locker shelf assembly of claim 6, wherein the locker shelf assembly has a peg for positioning in either the top peg opening or the bottom peg opening.

8. The locker shelf assembly of claim 7, wherein the peg is comprised of metal.

9. The locker shelf assembly of claim 1, wherein the material is plastic.

* * * * *